United States Patent [19]

Sato et al.

[11] 4,450,577

[45] May 22, 1984

[54] X-RAY APPARATUS

[75] Inventors: Hideki Sato, Ootawara; Hiroshi Asahina, Tochigi, both of Japan

[73] Assignee: Tokyo Shibaura Denki Kabushiki Kaisha, Kawasaki, Japan

[21] Appl. No.: 418,000

[22] Filed: Sep. 14, 1982

[30] Foreign Application Priority Data

Sep. 18, 1981 [JP] Japan ..... 56-146312

[51] Int. Cl.[3] ..... H05G 1/30; H05G 1/34

[52] U.S. Cl. ..... 378/109; 378/110

[58] Field of Search ..... 378/112, 110, 109, 111; 315/105, 106; 330/149

[56] References Cited

U.S. PATENT DOCUMENTS 1,912,755 6/1933 Braden ..... 315/105

4,253,048 2/1981 Osako ..... 378/110

FOREIGN PATENT DOCUMENTS 54-76087 6/1979 Japan .

OTHER PUBLICATIONS

Miyazaki et al., "D-C Filament Heating Method in X-Ray 12-Pulse Generator and Problems of it's Method," *Jap. Soc. Rad. Tech.*, May 1982, pp. 300-301.

Brezovitch et al., "An Investigation and Explanation of the Fall-Off of X-Ray Tube Current During an Exposure," *Phys. Med. Biol.*, 1980, vol. 25, No. 2, pp. 241-249.

*Primary Examiner*—Alfred E. Smith

*Assistant Examiner*—T. N. Grigsby

*Attorney, Agent, or Firm*—Cushman, Darby & Cushman

[57] ABSTRACT

An X-ray apparatus is disclosed which comprises an X-ray tube, a high voltage generating circuit for applying a high voltage between the anode and the cathode of the X-ray tube, a filament heating circuit for heating a filament of the X-ray tube, first switching element connected between one terminal of said filament and the negative bus of said high voltage generating circuit, second switching element connected between the other terminal of said filament and the negative bus of said high voltage generating circuit and an inverter circuit for alternately switching said first and second switching elements at a given period to switch the tube current paths.

4 Claims, 3 Drawing Figures

X-RAY APPARATUS

BACKGROUND OF THE INVENTION

The present invention relates to an X-ray apparatus with a stabilized tube current.

The typical picture data formed by the X-ray apparatus are X-ray photograph by direct photographing, X-ray photograph and X-ray cineradiograph by the indirect photographing using an image intensifier, tomograms by the computed tomography scanner, and the like. To improve a quality of the data, it is very important to stabilize the output of an X-ray source as a data source. Usually, an X-ray tube is used for the X-ray source. Conditions required for obtaining a stability of the output of the X-ray tube are that a tube voltage applied between the anode and the cathode of the X-ray tube is stable, and that the heating of the filament of the X-ray tube is stable.

In the prior measure taken for stabilizing the tube voltage, an AC power from a three-phase of power source is boosted to a higher voltage power by a transformer, the boosted power is full-wave rectified, and the pulsate component contained in the rectified power is absorbed by an electron tube inserted in series in the high voltage section, thereby to form a substantial DC power voltage. The DC voltage is then applied between the anode and the cathode of the X-ray tube.

For stabilizing the heating of the filament of the X-ray tube, a power for heating the filament must be kept constant. One of the methods to realize this is that a rectangular wave AC power is full-wave rectified into a DC power and the DC power is applied to the filament of the X-ray tube. According to this heating method, the supplied power little varies with time, realizing the stabilization of the filament heating.

The X-ray tube is provided with a focusing cap around the filament for focusing electron beams at a point. The filament is electrically connected at one end to the focusing cap, keeping potential of the filament equal to that of the focusing cap.

In the filament heating stabilizing method, a potential difference resides between the other other end of the filament and the focusing cap. But, the potential difference has no variation with time, so that no heating variation arises from the potential variation. Although this method is free from such potential variation problem, it has another problem that the tube current has an influence on the heating of the filament. This will be described below.

One end of the filament is connected at the cathode bus of a high voltage generating circuit. When the filament is heated with DC current as in the above case, a direction of the filament heating current is unidirectional. When the cathode bus is connected to the high potential side of the filament, the filament heating current and the tube current are opposite in the direction of their flows. Accordingly, the filament heating current is cancelled by the tube current, so that the heating effect of the filament is reduced by the amount of the filament current. As a result, the tube current decreases with time. On the other hand, when the cathode bus is connected to the low potential side of the filament, the filament heating current and the tube current flow in the same direction. Accordingly, the tube current is additively superposed on the filament heating current, so that the heating effect of the filament is increased by the amount of the superposed current. Accordingly, the tube current increases with time. As described above, the tube current changes according to the polarity of the voltage at the cathode of the X-ray tube. Consequently, an amount of X-ray radiated from the X-ray tube changes with the change of the tube current, decreasing the stability of the resultant X-ray data.

SUMMARY OF THE INVENTION

Accordingly, an object of the present invention is to provide an X-ray apparatus which is free from the adverse effect of the tube current upon the filament current and operable stably, providing high quality of X-ray data.

According to the present invention, there is provided an X-ray apparatus comprising an X-ray tube, a high voltage generating circuit for applying a high voltage between the anode and the cathode of the X-ray tube, a filament heating circuit for heating a filament of the X-ray tube, first switching element connected between one terminal of said filament and the negative bus of said high voltage generating circuit, second switching element connected between the other terminal of said filament and the negative bus of said high voltage generating circuit, and switching circuit means for alternately switching said first and second switching elements at a given period to switch the tube current paths.

DETAILED DESCRIPTION OF THE PREFERRED EMBODIMENT

Figure 1A:
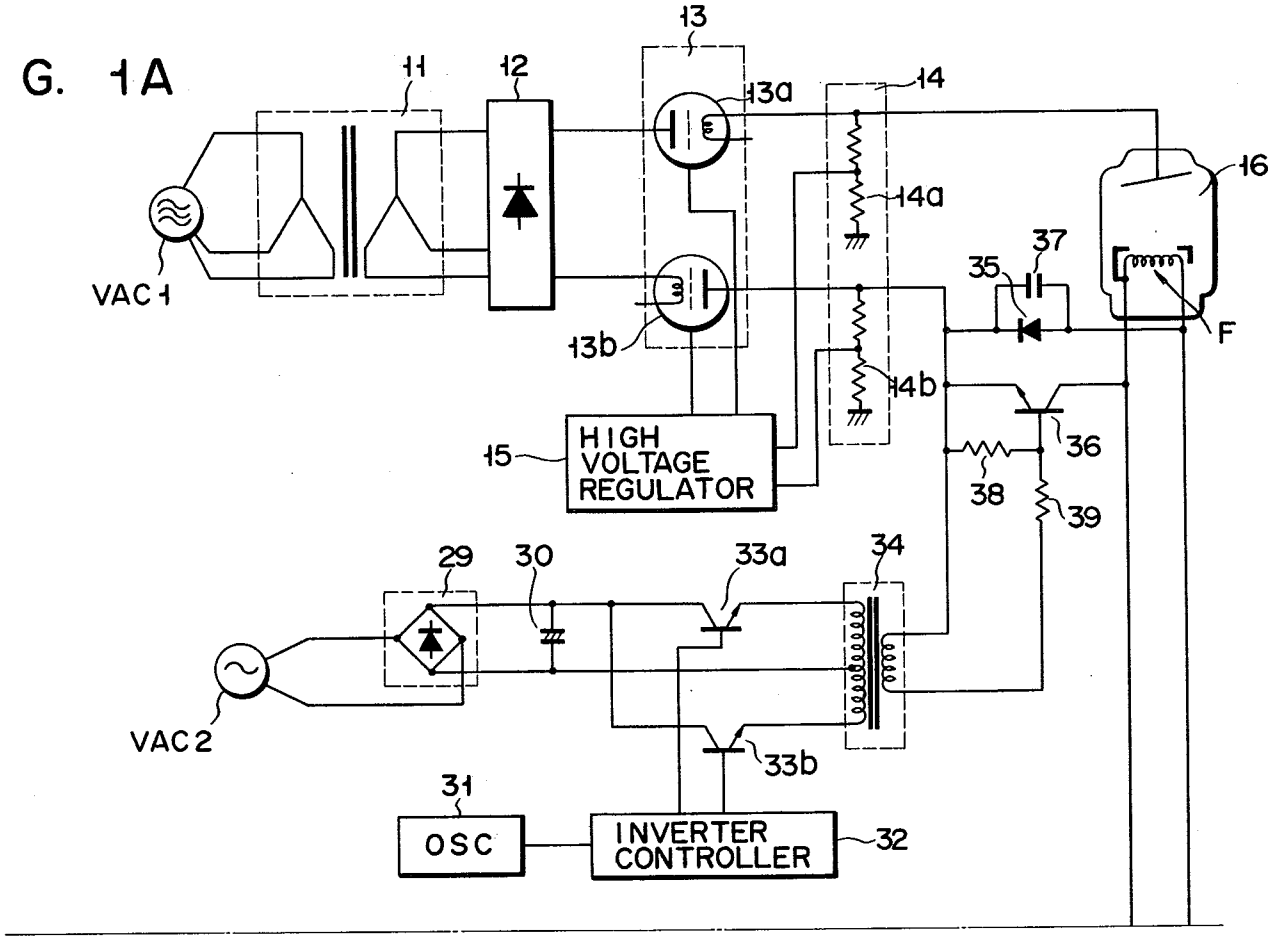
FIGS. 1A and 1B are a circuit diagram of an embodiment of an X-ray apparatus according to the present invention.
Figure 1B:
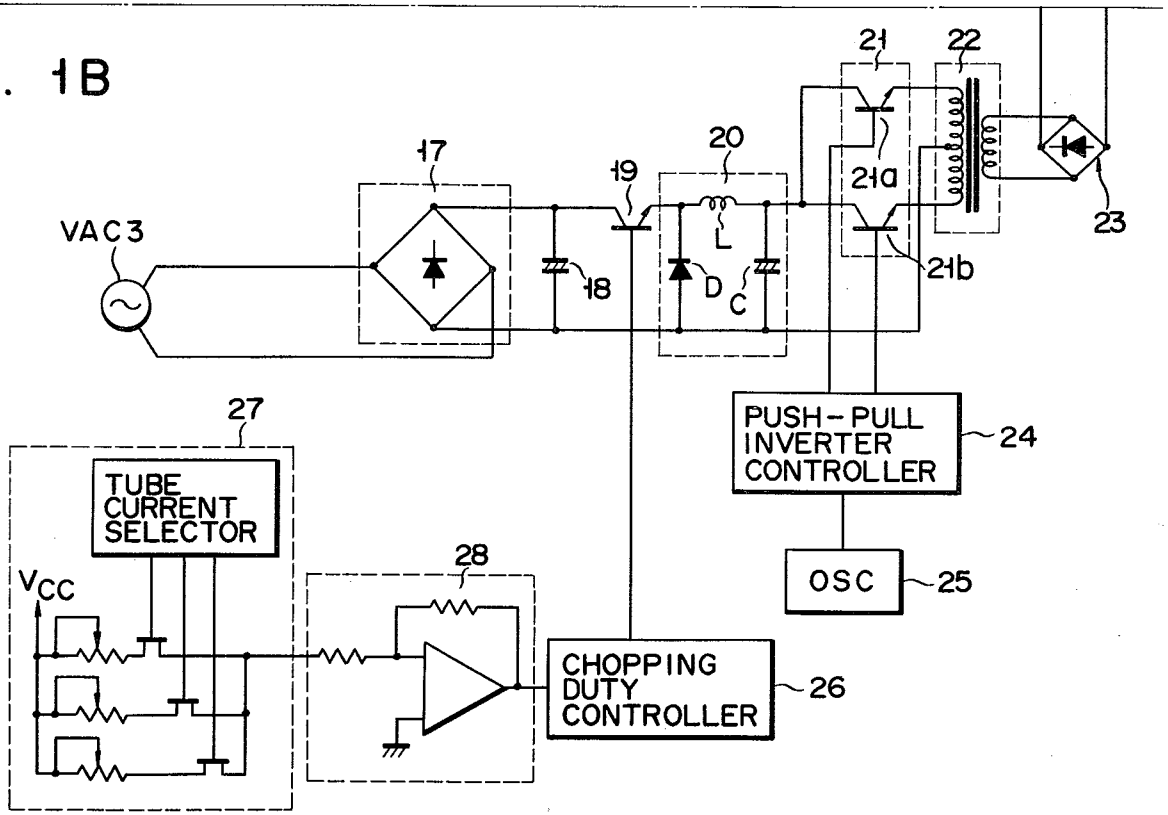

In FIGS. 1A and 1B, VAC1 designates a commercial three-phase power source. A high voltage transformer 11 transforms a power voltage from the power source VAC1 into a high voltage. A high voltage full-wave rectifier bridge 12 rectifies a power voltage from the transformer 11. A smoothing circuit 13 comprises two high voltage electron tubes **13*a* and 13*b* provided between the positive and the negative output terminals of the rectifier bridge 12. This circuit 13 smooths the output power voltage from the bridge to remove the pulsate components contained in the output power voltage from the bridge 12. A high voltage detecting divider 14 comprises two voltage dividing resistors 14*a*, 14*b* connected between the positive and the negative output terminals of the smoothing circuit 13, and detects the smoothed output voltage. A high voltage stabilizer 15 adjusts a grid bias voltage of each of the electron tubes 13*a* and 13*b* according to a detected value from the voltage detecting divider 14, thereby controlling an internal voltage drop of each electron tube 13*a* and 13*b*. The output power voltage with no pulsate component from the smoothing circuit 13** is applied as a tube voltage between the anode and the cathode of the X-ray tube, thereby to radiate X-rays.

Reference numeral 17 designates a full-wave rectifier bridge for full-wave rectifying a power voltage from a commercial single-phase AC power source VCA2, numeral 18 designates a capacitor for smoothing the rectified power voltage 19, a chopper transistor for chopping the smoothed and rectified output power voltage, numeral 20 designates a smoothing circuit comprising an inductance L, a capacitor C and a diode D and for smoothing the output power voltage from the chopper transistor 19. Reference numeral 21 represents an inverter made up of NPN transistors 21*a* and 21*b* which are connected at the collectors to the positive bus connecting to the output of the smoothing circuit 20. In a transformer 22 for insulation having a center tap at the primary coil, the center tap of the primary winding is connected to a load bus of the smoothing circuit 20 and the both ends of the primary winding are respectively connected to the emitters of the transistors 21*a* and 21*b*. Through the switching operations of these transistors 21*a* and 21*b*, the current flow direction may be changed at the center tap of the primary winding. A full-wave rectifier bridge 23 is provided between both ends of the filament of the X-ray tube 16. A push-pull inverter controller 24 generates a switch control signal for alternately switching the transistors 21*a* and 21*b*. A free-running oscillating circuit OSC 25 generates clock pulses for driving the push-pull inverter controller 24. The power voltage from the single-phase AC power source VCA2 is full-wave rectified by the full-wave rectifier bridge 17 and charged in the capacitor 18 and is used as a DC power source. Reference numeral 26 designates a chopping duty control circuit for generating a switch control signal for controlling the chopper transistor 19, reference numeral 27 a tube current selector for setting a tube current value, and reference numeral 28 a tube current level setter for generating a reference signal for providing a tube current level corresponding to the set current value. The chopping duty control circuit 26 controls a pulse width of a base control signal of the chopper transistor 19 so that a DC voltage at a level corresponding to the output signal from the tube current level setter 28. The full-wave rectifier bridge 23 full-wave rectifies the output power voltage from the secondary winding of the insulation transformer 22 and supplies it to the filament F of the X-ray tube 16. With such an arrangement, the filament voltage is so controlled that the tube current set by the tube current selector 27 flows into the X-ray tube 16.

Reference numeral 29 designates a full-wave rectifier bridge for full-wave rectifying a power voltage from a commercial single-phase AC power source VCA3; 30 a capacitor for smoothing the rectified power voltage from the full-wave rectifier bridge 29; 31 a free-running oscillator circuit OSC oscillating at fixed periods; 32 an inverter control circuit for generating a drive signal for transistors 33*a* and 33*b* comprising an inverter when it is driven by an oscillating output signal from the oscillator 31. The transistors 33*a* and 33*b*, connected at the collectors to the positive terminal of the capacitor 30, alternately operates in response to the output signal from the inverter controller 32. An insulation transformer 34 with a center tap at the primary winding is connected at the center tap to the negative terminal of the capacitor 30 and at both ends of the primary winding to the emitters of the transistors 33*a* and 33*b*. The direction of the current in the primary winding may be switched by alternately driving the transistors 33*a* and 33*b* by the inverter controller 22. A diode 35 and a transistor 36 are connected in a back-to-back fashion. The cathode of the diode 35 and the emitter of the transistor 36 are connected to an anode of the high voltage electron tube 13*b* connected to the negative bus of the smoothing circuit 13. The anode of the diode 35 is connected to the negative potential terminal of the filament F. The collector of the transistor 36 is connected to the positive potential side of the filament F. The tube current flowing through the filament F is led to the negative bus through the diode 35 or the transistor 36. A capacitor 37, connected across the diode 35, exhibits a low impedance for high frequencies. Resistors 38 and 39 are connected in series across the secondary winding of the insulation transformer 34, and the resistor 38 is connected across the base-emitter path of the transistor 38. With this connection, these resistors voltage divides the output voltage from the insulation transformer 34 for the application thereof to the transistor 36.

With such an arrangement, electric power from the AC power soruce VCA1 is boosted by the high voltage transformer 11 and is then full-wave rectified by the high voltage full-wave rectifier bridge 12. The rectified output power contains a pulsate component. The pulsate DC power is then applied to both the electrodes of the X-ray tube 16 through the smoothing circuit 13 comprising the high voltage electron tubes 13*a* and 13*b*. The combination of the electron tubes 13*a* and 13*b* are provided for removing the pulsate component contained in the DC output from the bridge 12. The high voltage detecting divider 14 detects a level of the high voltage applied to the X-ray tube 16 to extract only a variation and applies the variation to the high voltage stabilizer 15 for generating a grid bias voltage to control the internal voltage drops across the electron tubes 13*a* and 13*b*. Upon receipt of the variation, the stabilizer 15 produces such a grid bias voltage as to supress the pulsating component, and applies it to the electron tubes 13*a* and 13*b*. As a result, the electron tubes 13*a* and 13*b* respectively have internal voltage drops, so that the stabilized tube voltage is applied to the X-ray 16.

The filament voltage for determining the tube current is supplied from the single-phase AC power source VCA3. The power supplied from the AC power source VCA3 is full-wave rectified by the full-wave rectifier bridge 17 and its pulsate component is removed through the capacitor 18, thereby to be a DC power source. The DC output charged in the capacitor 18 is applied to a load, or the X-ray tube 16, through the transistor 19 which is conductive only during the period that it receives the signal produced from the chopper control circuit 26. A reference signal corresponding to the tube current set by the tube current selector 27 is produced from the tube current level setter 28, and the chopping duty control circuit 26 applies the control signal to provide a chopping duty corresponding to the reference signal to the transistor 19. Accordingly, the DC power chopped by the transistor 19, which is enough to provide a filament voltage necessary for obtaining the set current value, is applied to the load. The chopped rectifier output power is smoothed by the smoothing circuit 20 to be a DC power source at voltage corresponding to the signal derived from the chopping duty control circuit 26. The DC current is converted into a rectangular wave AC by the circuit including the free-running oscillator circuit 25. Specifically, the free-running oscillator circuit 25 produces an output signal of a fixed frequency and applies the output signal to the drive control circuit 24 for the transistors 21*a* and 21*b*. The control circuit 24 generates drive control signals. The control signals are supplied to the transistors 21*a* and 21*b* to alternately switch the transistors 21*a* and 21*b*. The alternate conduction of the transistors 21*a* and 21*b* allows the chopped signals smoothed by the smoothing circuit 20 to alternately pass to the primary winding of the insulation transformer 22. The current flow at the center tap of the primary winding connected to the negative terminal of the smoothing circuit 20 changes its direction according to the ON and OFF of the transistors 21*a* and 21*b*. The result is that a rectangular AC high voltage at this switching periods is obtained from the secondary winding of the insulation transformer 22. The boosting voltage output is full-wave rectified by the full-wave bridge 23 and is applied to the filament F of the X-ray tube, so that the filament F is stably heated.

The chopper duty controller 26 phase modulates the output level of the tube current level setter 28 and applies the modulated signal to the transistor 19, thereby to chop the rectified output from the rectifier circuit 17. As a result, a rectangular wave signal corresponding to the chopping duty is obtained and applied to the filament F of the X-ray tube. Then, the filament is heated to provide thermionic emission corresponding to temperature of the heated filament, resulting in flow of the corresponding tube current. Thus, the X-ray tube 16 radiates X-rays at a dosage corresponding to the tube current or voltage.

The above description relates to the circuit operation for the X-ray radiation. To secure a stable X-ray radiation, an adverse influence of the tube current flowing through the filament F must be minimized. This is realized by a correcting circuit made up of the circuit components 29 to 39 in FIG. 1. This will be given below.

The AC power from the power source VCA2 is full-wave rectified by the rectifier bridge 29 and is smoothed by the capacitor 30, thereby to provide a DC power source. The free-running oscillator 31 produces an output signal of fixed periods. The output signal from the oscillator is applied to the inverter controller 32. Then, the controller 32 alternately controls inverter transistors 33*a* and 33*b* at fixed periods. Through the alternate switching of the transistors 33*a* and 33*b*, the voltage applied to the primary winding of the transformer 34 alternately changes its polarity with respect to the center tap at the switching period of these transistors or the oscillating period of the oscillator 31. As a result, a high voltage rectangular AC voltage is induced in the secondary winding of the transistor 34 and is applied to between the resistors 38 and 39 connected in series across the secondary winding. The rectangular wave AC voltage is voltage divided by the resistor network and applied to the base-emitter path of the transistor 36. When a positive potential is applied to the base of the transistor 36, the transistor 36 is conductive. At this time, the diode is backwardly biased by the filament heating voltage. The diode 35 is rendered nonconductive. When the X-ray is radiated under this condition, the tube current flows through the transistor 36 and returns back to the cathode of the tube voltage generating circuit or the negative bus (coupled with the high voltage electron tube 13*b*). When a negative potential is applied to the base of the transistor 36, the transistor 36 is nonconductive and the diode 35 is forwardly biased. Accordingly, the tube current flows through the diode 35 and is fed back to the negative bus of the high voltage generating circuit. In this way, the direction of the tube current flowing through the filament F is switched with the instantaneously changing polarity of the rectangular AC voltage produced from the insulation transformer 34. When the current direction is switched during the X-ray radition, the diode 35 and the transistors 36 exhibit a transient instability during the switching operation. To avoid this, the capacitor 37 is connected across the diode 35 to provide a low impedance path for the diode 35. If the period of the rectangular AC voltage is selected shorter than a period given by a thermal time constant of the filament F so as to provide a negligible temperature variation, a variable in the heating of the filament due to the tube current may automatically be corrected to provide a stable filament heating. Generally, time taken for the filament to be cooled down is shorter than time taken for it to be heated. Therefore, it is necessary to set high the chopping duty of the current feed at the time of the heating, in order to have highly accurate X-ray diagnosis data.

Figure 2:
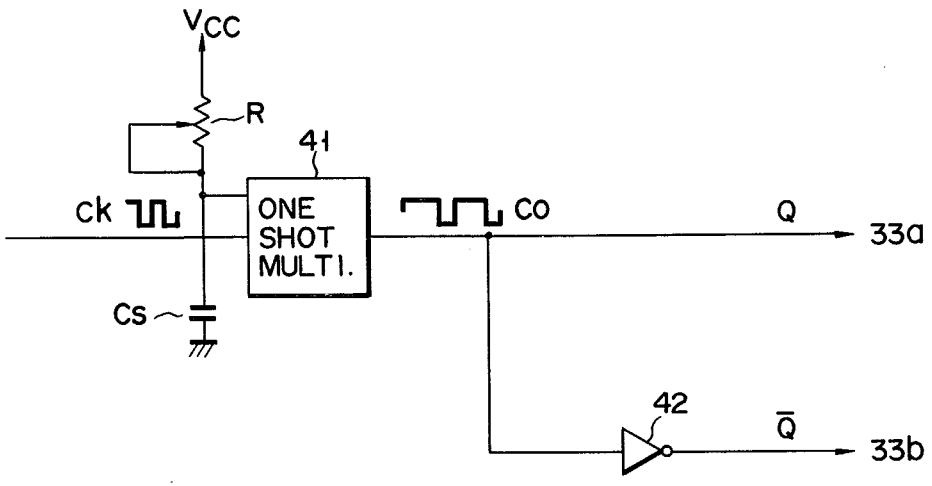
FIG. 2 is a circuit diagram of an inverter controller used in the X-ray apparatus of FIG. 1.

FIG. 2 illustrates an example of an arrangement of the inverter controller used in the circuit of FIG. 1.

A one-shot multivibrator 41 is coupled at one input terminal to a clock pulse Ck from the oscillator 41 and at the other input terminal to potential Vcc through a variable resistor R and to ground through a capacitor Cs. The variable resistor R and the capacitor Cs are used to provide a time constant of the one-shot multivibrator 41. The time constant may properly be set by adjusting the variable resistor R. In response to the clock pulse Ck, the one-shot multivibrator 41 provides a pulse signal Co with a pulse width based on the time constant determined by the resistor R and the capacitor Cs. The output pulse Co is directly applied as a signal Q to the transistor 33*a*. The same is phase inverted by an inverter 42 and applied as a signal $\overline{Q}$ to the transistor 33*b*. The signals Q and $\overline{Q}$ alternately switch the transistors 33*a* and 33*b*.

It should be understood that the present invention may variously be changed within the scope of the present invention. While the above-mentioned embodiment is applied for a direct current for the filter current, it may be applied for an alternate filament current since in the case of the AC filament current, it has the influence by the tube current, although it is less than that by the DC. It is evident that the diode and the transistor, which are used for switching the direction of the tube current, may be substituted by any other switching elements such as electron tubes.

As seen from the foregoing, in the X-ray apparatus according to the present invention, both ends of the filament are connected through the diode and the transistor to the negative bus of the high voltage generating circuit for providing the X-ray voltage. A circuit is further provided to control ON and OFF of the transistor at a period shorter than the thermal time constant of the filament to such an extent that the temperature change is negligible. That is, the direction of the tube current flowing through the filament is switched. Therefore, little variation of temperature of filament is produced by the tube current flowing through the filament, thereby ensuring a stable filament heating. Consequently, the X-ray apparatus according to the present invention provides a stable X-ray radiation and a high accurate X-ray diagnosis apparatus.

What we claim is:

1. An X-ray apparatus comprising:

an X-ray tube;

a high voltage generating circuit for applying a high voltage between the anode and the cathode of said X-ray tube;

a direct current filament heating circuit for heating a filament of said X-ray tube;

first switching element connected between one terminal of said filament and the negative bus of said high voltage generating circuit;

second switching element connected between the other terminal of said filament and the negative bus of said high voltage generating circuit; and switching circuit means for alternately switching said first and second switching elements at a given period to switch the tube current paths.

2. An X-ray apparatus according to claim 1, further including, impedance means for preventing an instable state at the time of the alternate switching of said first and second switches, said impedance means being connected across said first switching element.

3. An X-ray apparatus according to claim 1 or 2, wherein said first switching element is a diode and said second switching element is a transistor.

4. An X-ray apparatus according to claim 2, wherein said impedance means is a capacitor.

* * * * *